US006460188B1

(12) United States Patent
Hatton

(10) Patent No.: US 6,460,188 B1
(45) Date of Patent: Oct. 8, 2002

(54) TWO PIECE PATIENT EXAMINATION GARMENT

(76) Inventor: Richard L. Hatton, 2037 E. Grand River Ave., Okemos, MI (US) 48864

( * ) Notice: Subject to any disclaimer, the term of this patent is extended or adjusted under 35 U.S.C. 154(b) by 8 days.

(21) Appl. No.: 09/697,215

(22) Filed: Oct. 26, 2000

(51) Int. Cl.[7] ..... A41D 13/00

(52) U.S. Cl. ..... 2/114; 2/69

(58) Field of Search ..... 2/114, 88, 109, 2/69, 69.5, 71, 104–106, DIG. 1, 74, 80, 83, 75, 93–95, 238, 85, 227–228, 79, 78.1–78.3, 400, 403, 408, 405, 406, 220, 221, 211, 73, 242, 113, 115, 50, 51, 46; 128/849, 850, 853, 854, 855, 869, 872, 873, 874; 604/385.1–396

(56) References Cited

U.S. PATENT DOCUMENTS

| | | | | | |
|---|---|---|---|---|---|
| 512,229 | A | * | 1/1894 | Shelley | 2/78.3 |
| 818,351 | A | * | 4/1906 | Clark | 2/114 |
| 1,000,155 | A | * | 8/1911 | Dietz | 2/211 |
| 1,704,887 | A | * | 3/1929 | Flavell et al. | 2/78.1 |
| 2,010,483 | A | * | 8/1935 | Goodman | 2/78.1 |
| 2,497,764 | A | * | 2/1950 | Doughty | 2/114 |
| 2,593,121 | A | | 4/1952 | Djorup | |
| 2,707,282 | A | * | 5/1955 | Paterson | 2/114 |
| 3,230,546 | A | * | 1/1966 | Sabee | 2/114 |
| 3,464,063 | A | | 9/1969 | Hoegerman | |
| 4,205,398 | A | | 6/1980 | Blume | |
| 4,266,299 | A | * | 5/1981 | Beal | 2/46 |
| 4,382,303 | A | | 5/1983 | Lunt | |
| 4,434,511 | A | | 3/1984 | Weiser | |
| 4,446,575 | A | * | 5/1984 | Davis | 2/400 |
| 4,473,908 | A | | 10/1984 | Knecht | |
| 4,695,279 | A | * | 9/1987 | Steer | 604/385.1 |
| 4,718,124 | A | * | 1/1988 | Sawick et al. | 2/114 |
| 4,759,083 | A | | 7/1988 | Belcher | |
| 4,892,536 | A | * | 1/1990 | DesMarais et al. | 604/385.2 X |
| 4,930,161 | A | * | 6/1990 | Cohen | 2/114 |
| 5,062,159 | A | * | 11/1991 | Jakub | 2/70 X |
| 5,088,117 | A | | 2/1992 | Fulmer | |
| 5,093,932 | A | | 3/1992 | Doyle | |
| 5,097,536 | A | | 3/1992 | Cohen | |
| 5,207,663 | A | * | 5/1993 | McQueen | 604/385.1 |
| 5,327,586 | A | * | 7/1994 | Evans et al. | 2/211 |
| D352,577 | S | * | 11/1994 | Shover | 2/400 |
| 5,440,763 | A | | 8/1995 | Shah et al. | |
| 5,444,872 | A | | 8/1995 | Johnson | |
| 5,553,323 | A | | 9/1996 | Chou et al. | |
| 5,564,126 | A | | 10/1996 | Chou | |
| 5,575,006 | A | | 11/1996 | Wolfe | |
| 5,661,852 | A | | 9/1997 | Kessler | |
| 5,768,707 | A | | 6/1998 | Lederer | |
| 5,799,330 | A | * | 9/1998 | O'Donoghue-Kitt | 2/114 |
| 5,802,611 | A | | 9/1998 | McKenzie et al. | |
| 5,878,437 | A | | 3/1999 | Pater | |
| 5,887,279 | A | | 3/1999 | Elting et al. | |
| 6,327,712 | B1 | * | 12/2001 | Armstrong et al. | 2/104 |

* cited by examiner

*Primary Examiner*—Gloria M. Hale
(74) *Attorney, Agent, or Firm*—MacMillan, Sobanski & Todd, LLC

(57) ABSTRACT

An examination garment to be worn by a patient during a physical, examination includes an upper garment and a lower garment. The upper garment includes a first front panel, a second front panel, a rear panel having an opening for examination of a patient's spine, and fasteners for removably connecting various points of the front and rear panels. The lower garment includes a waistband, a first front panel overlapping at least a portion of a second front panel, a front central panel overlapped by the first and second front panels, a rear outer panel, a rear inner panel having an opening overlapped by the rear outer panel, and fasteners for removably connecting the front and rear panels.

20 Claims, 9 Drawing Sheets

TWO PIECE PATIENT EXAMINATION GARMENT

CROSS-REFERENCE TO RELATED APPLICATION

This application claims the benefit of U.S. provisional patent application Ser. No.60/162,689 filed Nov. 11, 1999.

BACKGROUND OF THE INVENTION

This invention relates in general to garments worn by patients during physical examinations conducted by physicians.

When a physician conducts a physical examination of a patient, it is desirable to balance the physician's need for access and the patient's desire for coverage. In general, an examination can be best performed when a patient is comfortable with the procedure. To reduce embarrassment and maintain body temperature, various garments have been developed. These garments can be reusable or disposable, and can be formed from a variety of materials. Furthermore, various garments have been developed for specific areas of a body.

SUMMARY OF THE INVENTION

This invention includes a garment worn by a patient during a physical examination. The garment provides accessibility of various parts of the body while providing a satisfying amount of coverage for a patient. The garment includes an upper garment covering portions of the upper torso and a lower garment covering the pelvic region. The garment can be formed from any desired material as a disposable or reusable garment.

In a preferred embodiment, an examination garment to be worn by a patient during a physical examination includes an upper garment and a lower garment. The upper garment includes a first front panel, a second front panel, a rear panel having an opening for examination of a patient's spine, and fasteners for removably connecting various points of the front and rear panels. The lower garment includes a waistband, a first front panel overlapping at least a portion of a second front panel, a front central panel overlapped by the first and second front panels, a rear outer panel, a rear inner panel having an opening overlapped by the rear outer panel, and fasteners for removably connecting the front and rear panels.

Various objects and advantages of this invention will become apparent to those skilled in the art from the following detailed description of the preferred embodiment, when read in light of the accompanying drawings.

DETAILED DESCRIPTION OF THE PREFERRED EMBODIMENTS

Figure 2:
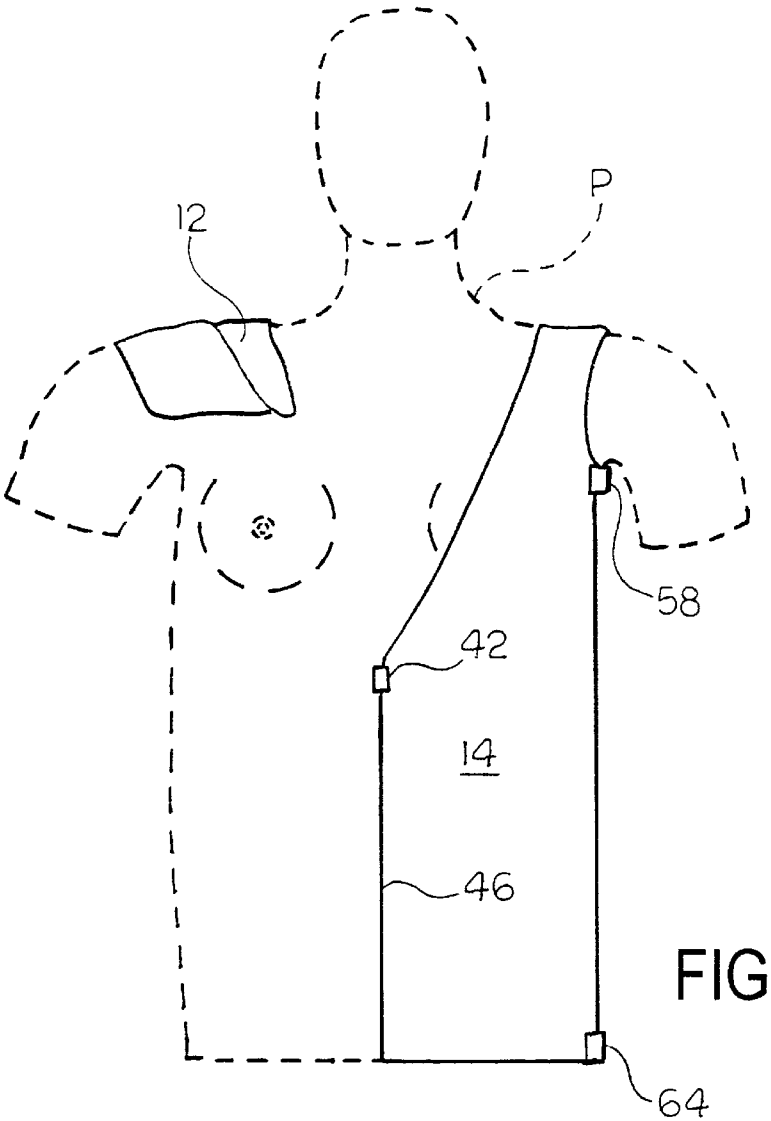
FIG. 2 is a front view of the upper garment of FIG. 1 worn by a patient illustrated in phantom lines wherein the first front panel has been folded upwardly for a breast examination.
Figure 1:
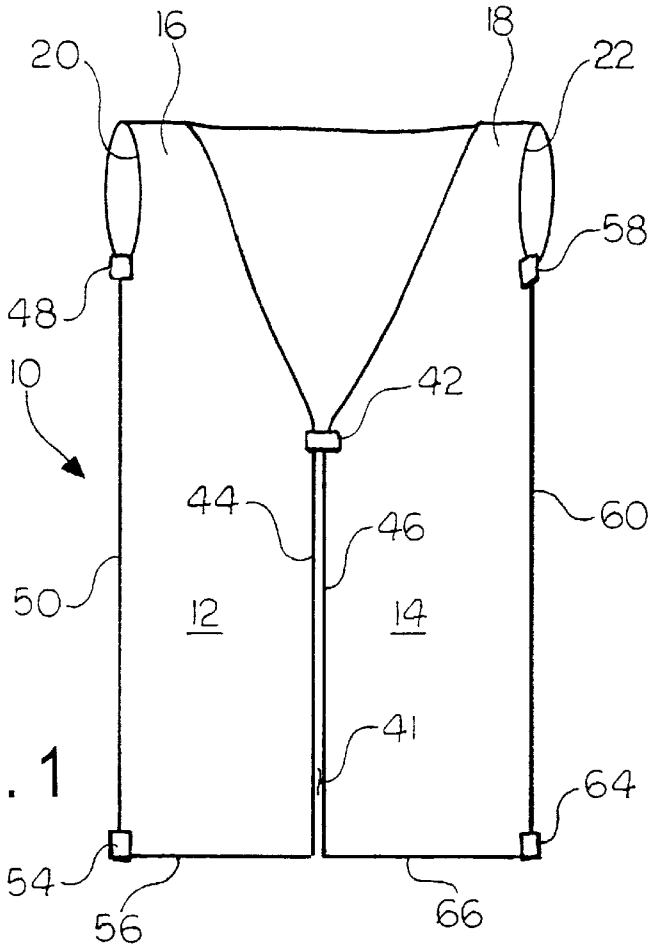
FIG. 1 is a front view of an upper garment according to this invention illustrating first and second front panels.

A two piece patient garment according to this invention includes an upper garment indicated generally at 10 in FIGS. 1, 2, 3, 4, and 11 and a lower garment indicated generally at 100 in FIGS. 5, 6, 7, 8, and 9.

The upper garment 10 is fitted about the upper torso of a patient and extends generally to the lower hip and buttock level of a patient. The upper garment 10 is designed to permit a physician to conduct a clinical examination of a patient from the waist to the head with minimal manipulation of the garment 10 while providing a satisfying amount of coverage for the patient.

The upper garment 10 includes a first front panel 12 and a second front panel 14. Upper sections 16 and 18 of the panels 12 and 14, respectively, are received over a shoulder of a patient. A patient's neck is received between upper sections 16 and 18. Openings 20 and 22 are sized to permit examination of the shoulder and arm pit areas without removal of the upper garment 10.

The upper garment 10 also includes a rear panel 23 divided into. a first rear panel 24 and a second rear panel 26. The rear panels 24 and 26 include upper sections 28 and 30, respectively that are joined with upper sections 16 and 18. In one preferred embodiment, upper section 28 is connected to upper section 18, and upper section 30 is connected to upper section 16. In other embodiments, the upper sections can be joined as desired.

The rear panels 24 and 26 include cutouts 32 and 34 that form an orthopedically designed slot 36 to expose a patient's spine. The slot 36 can be formed with any configuration. An opening for examination of another desired area can be formed in lieu of or in addition to the slot 36. A slit 40 can be provided between lower portions of the panels 24 and 26 to permit one or both panels to be folded for examination.

Various fasteners are used to join the panels 12, 14, 24, and 26 together. Preferably, metal fasteners are used for cloth garments and crimps are used for paper garments. However, other types of fasteners can be used.

Fastener 42 joins an inner edge 44 of the first front panel 12 with an inner edge 46 of the second front panel 14 at a level close to the breastbone. Fastener 48 is provided to join an outer edge 50 of the first front panel 12 with an outer edge 52 of the first rear panel 24 beneath cutout 20. Fastener 54 is provided at a bottom edge 56 of the first front panel 12 to join outer edges 50 and 52.

Fastener 58 is provided to join an outer edge 60 of the second front panel 14 with an outer edge 62 of the second rear panel 26 beneath cutout 22. Fastener 64 is provided at a bottom edge 66 of the second front panel 14 to join outer edges 60 and 62. Fastener 69 can be provided at or near a lower end of the slot 36.

Front panels 12 and 14, rear panels 24 and 26, and openings 20 and 22 are sized so that they the panels meet at the lowest point of the armpits and are connected by fasteners 48 and 58. The fasteners 48 and 58 stabilize the upper garment 10 so that it will not slip or fall off a patient.

Figure 4:
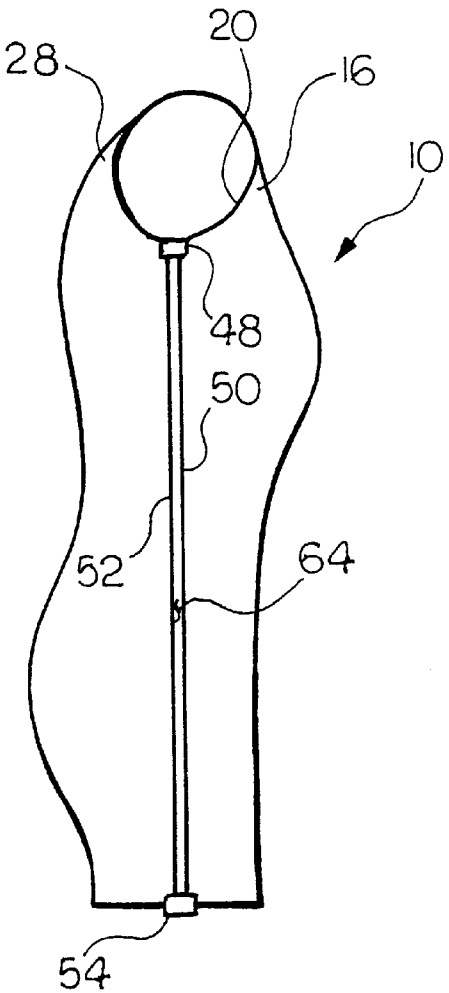
FIG. 4 is a side view of the upper garment illustrated in FIGS. 1, 2, and 3.
Figure 3:
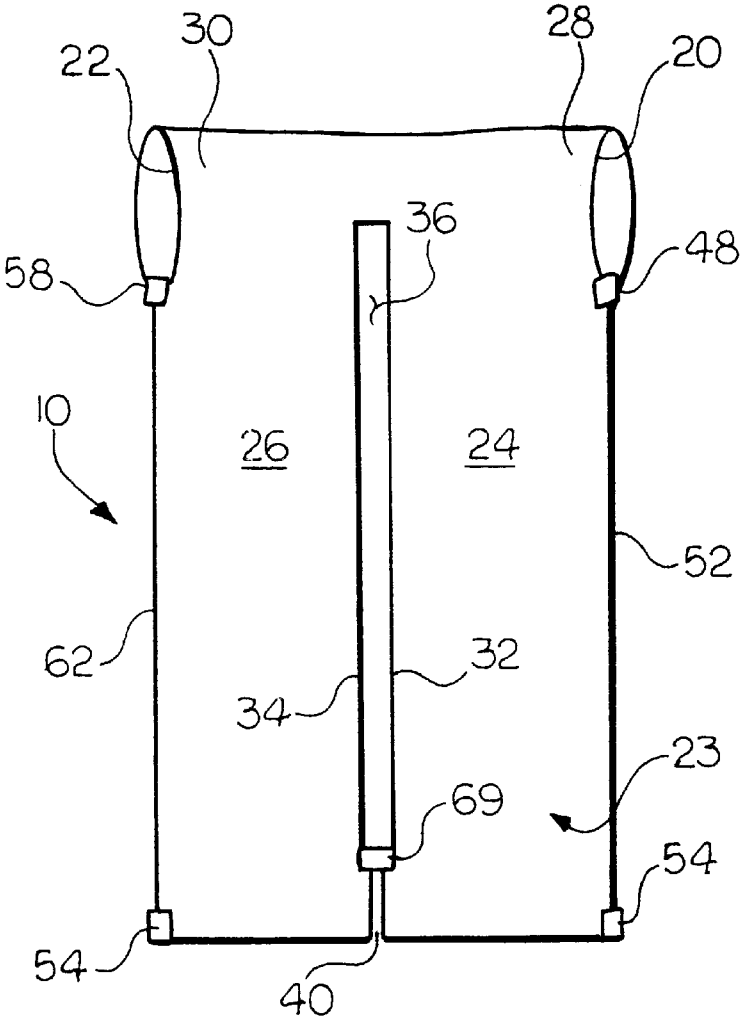
FIG. 3 is a rear view of the upper garment illustrated in FIGS. 1 and 2.

As shown in FIG. 4, a slit 64 is formed along a patient's side between the outer edges 50 and 52 when fasteners 48 and 50 at the top of edges 50 and 52 are mated. Slit 64 permits access for an examination without disturbing the remainder of the upper garment 10.

Properly selected fasteners on the upper garment 10 can be released to permit a panel to be folded for examination. For example, in FIG. 2 the first front panel 12 is shown folded upwardly to permit examination of a breast of a patient P. The remainder of the upper garment 10 does not have to be disturbed, thus providing a patient with coverage. The first front panel 12 can be draped over a patient's shoulder.

In another embodiment, the upper garment 10 can be formed from a single piece of material having a front panel, a rear panel, and cutouts for the neck and arms. A slot like slot 36 can be cut from the rear panel. The slot 36 can have a predetermined width extending equal distances from a midline. Also, a slit like slit 40 can be provided in the rear panel. A slit like slit 41 can be provided in the front panel.

Any number of fasteners can be used with the panels 12, 14, 24, and 26. More fasteners, less fasteners, and the number of fasteners illustrated in FIGS. 1–4 are within the scope of the present invention.

Figure 5:
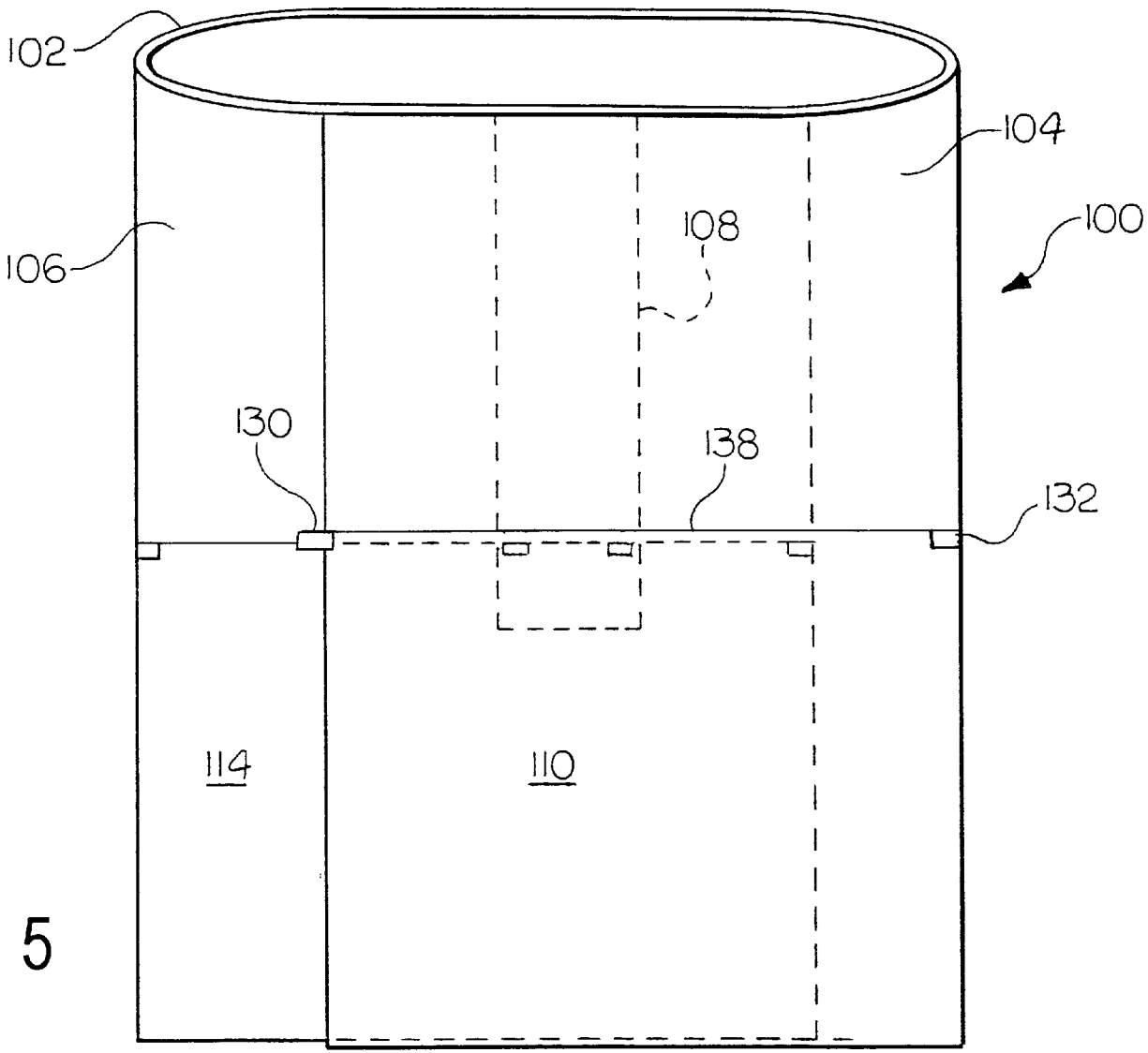
FIG. 5 is a front view of a lower garment according to this invention illustrating first and second overlapping front panels.
Figure 6:
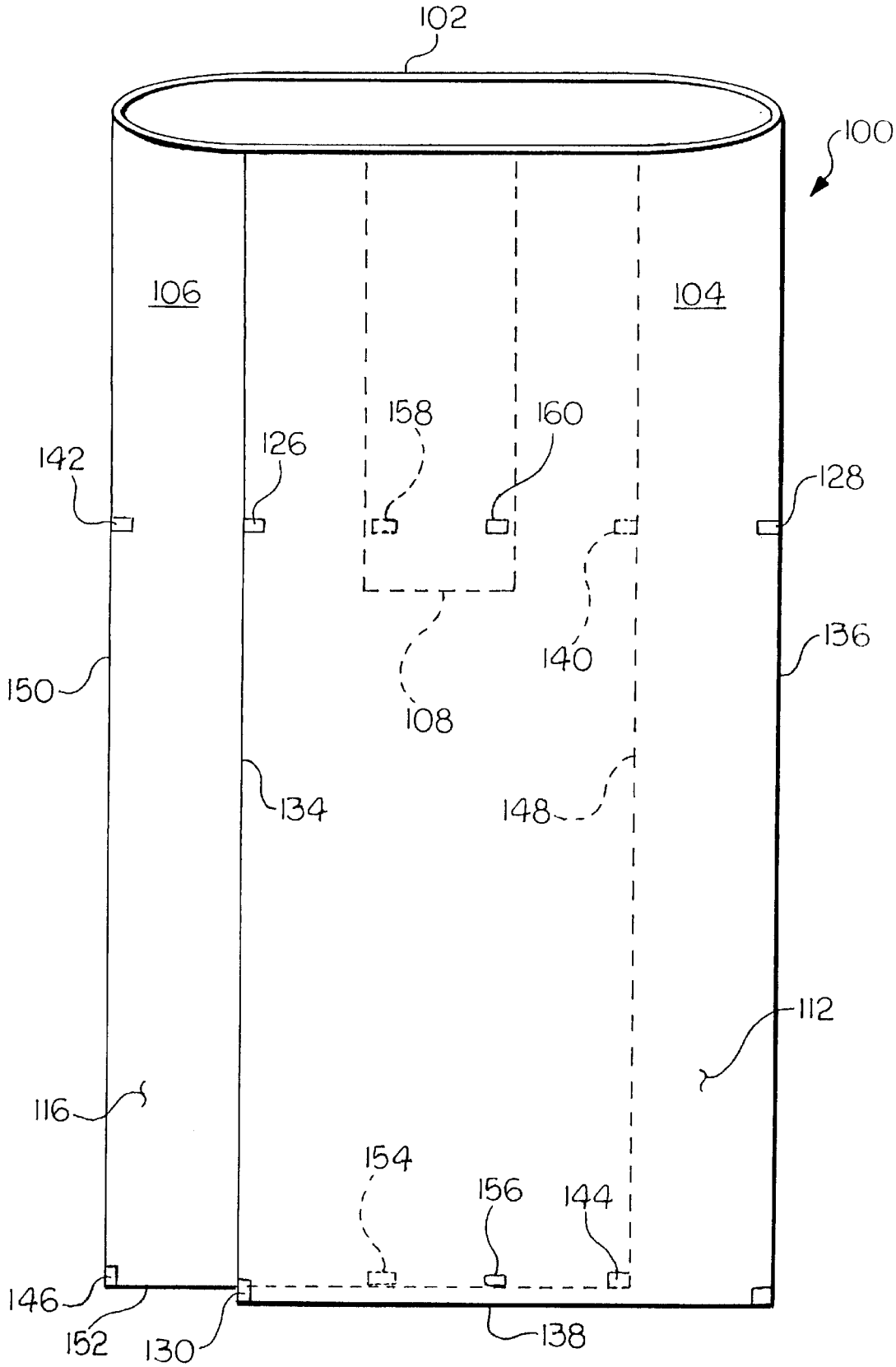
FIG. 6 is a front view of the lower garment of FIG. 5 wherein the front panels have been extended to form leggings.
Figure 7:
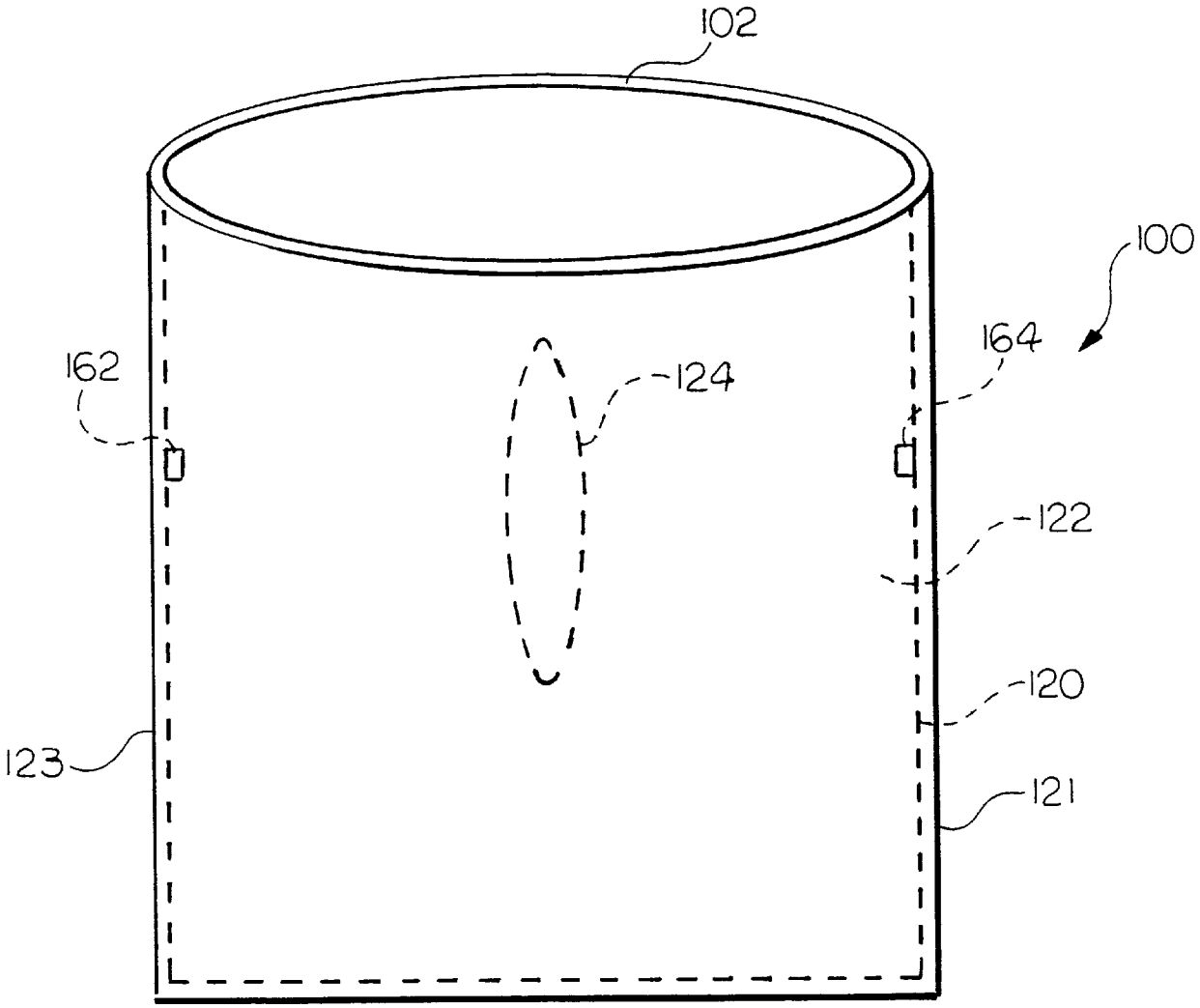
FIG. 7 is a rear view of the lower garment illustrated in FIG. 5.
Figure 8:
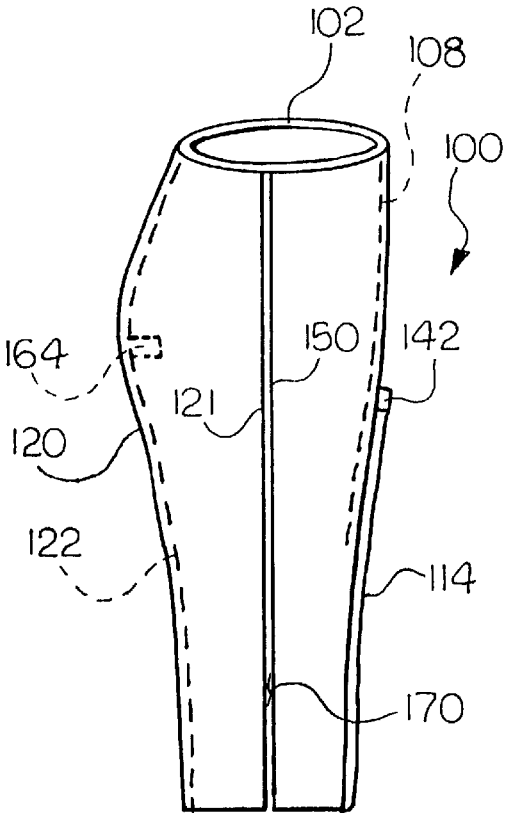
FIG. 8 is a side view of the lower garment illustrated in FIG. 5.
Figure 9:
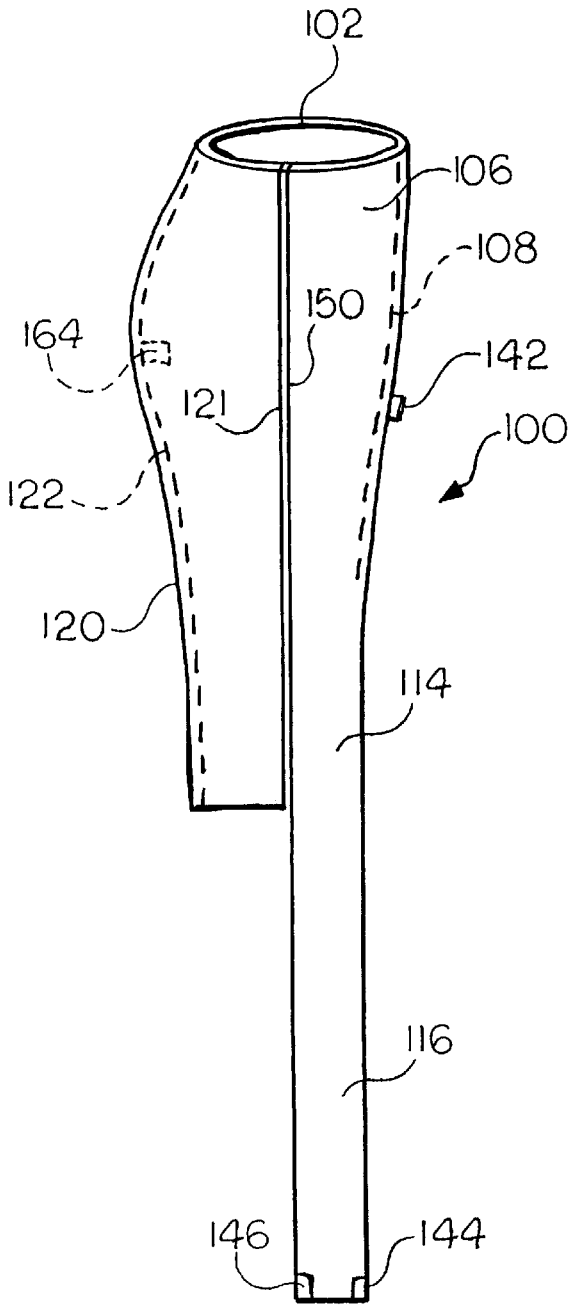
FIG. 9 is a side view of the lower garment illustrated in FIG. 6.

A lower garment for a patient is indicated generally at 100 in FIGS. 5, 6, 7, 8 and 9. In a folded position, as shown in FIGS. 5, 7, and 8, the lower garment 100 is fitted about the waist level of a patient and extends to approximately knee level, resembling a skirt. In the extended position, as shown in FIGS. 6 and 9, two anterior panels can be extended to the ankle area. The lower garment 100 is designed to permit a physician to conduct a clinical examination of a patient's abdomen, genitalia, anal and rectal areas, and lower extremities while provided a satisfying amount of patient coverage.

The lower garment 100 includes a waistband 102, preferably formed from an elastic material that supports the lower garment 100 at approximately waist level. A first front panel 104 and a second front panel 106 are attached to the waistband 102 and partially overlap one another. A central, inner front panel 108 is also attached to the waistband 102 and is overlapped by panels 104 and 106. The central panel 108 is sized to cover a patient's external genitalia. Each of panels 104 and 106 can be independently folded on the abdomen for an examination of one or both lower extremities without disturbing the central panel 108.

In FIG. 5, the panels 104 and 106 are illustrated in a stored or folded position so that coverage extends to approximately the level of the knees. In FIGS. 6 and 9, panels 104 and 106 can be folded down as shown to provide leggings 112 and 116, respectively.

As shown in FIGS. 7, 8, and 9, the lower garment 100 also includes an outer rear panel 120 and an inner rear panel 122. Preferably, the panels 120 and 122 are attached to the waistband 102. The outer rear panel 120 overlaps the inner rear panel 122. The inner rear panel 122 includes an opening 124 sized to permit anal and rectal examinations. The outer rear panel 120 includes side edges 121 and 123.

As illustrated best in FIG. 6, fasteners 126, 128, 130, 132, 156 and 160 are provided on the first front panel 104. Fastener 126 is provided along an inner edge 134 at a central portion of its length. Fastener 128 is provided along an outer edge 136 at a central portion of its length. Fastener 130 is provided along the inner edge 134 at a bottom edge 138 of the panel 104. Fastener 132 is provided along the outer edge 136 at the bottom edge 138. Fastener 156 is provided approximately midway between fasteners 130 and 132. Fastener 160 is provided approximately midway between fasteners 126 and 128.

Fasteners 140, 142, 144, 146, 154, and 158 are provided on the second front panel 106. Fastener 140 is provided along an inner edge 148 at a central portion of its length. Fastener 142 is provided along an outer edge 150 at a central portion of its length. Fastener 144 is provided along the inner edge 148 at a bottom edge 152 of the panel 106. Fastener 146 is provided along the outer edge 150 at the bottom edge 152. Fastener 158 is provided approximately midway between fasteners 140 and 142. Fastener 154 is provided approximately midway between fasteners 144 and 146.

In the folded position (see FIG. 5), fastener 130 is mated with fastener 126, fastener 132 is mated with fastener 128, and fastener 156 is mated with fastener 160 to retain the legging 112. Fastener 144 is mated with fastener 140, fastener 146 is mated with fastener 142, and fastener 154 is mated with fastener 158 to retain the legging 116.

In the extended (unfolded) position (see FIGS. 6 and 9), fasteners 130 and 132 can be mated to wrap the legging 112 about a patient's leg. Fasteners 144 and 146 can be mated to wrap the legging 116 about a patient's leg.

As illustrated in FIG. 7, the rear inner panel 122 can include fasteners 162 and 164 provided at its outer edges. Fastener 162 can be mated to fastener 128 on panel 104 and fastener 164 can be mated to fastener 142 on panel 106 to stabilize the rear inner panel 122, particularly when a patient is lying on a side for an examination.

As illustrated in FIGS. 8 and 9, a slit 170 is provided between outer edge 150 and side edge 121. The slit 170 permits access to the hip region without disturbing he remainder of the lower garment 100. A similar slit (not illustrated) is provided on the opposite side of the lower garment.

Figure 10:
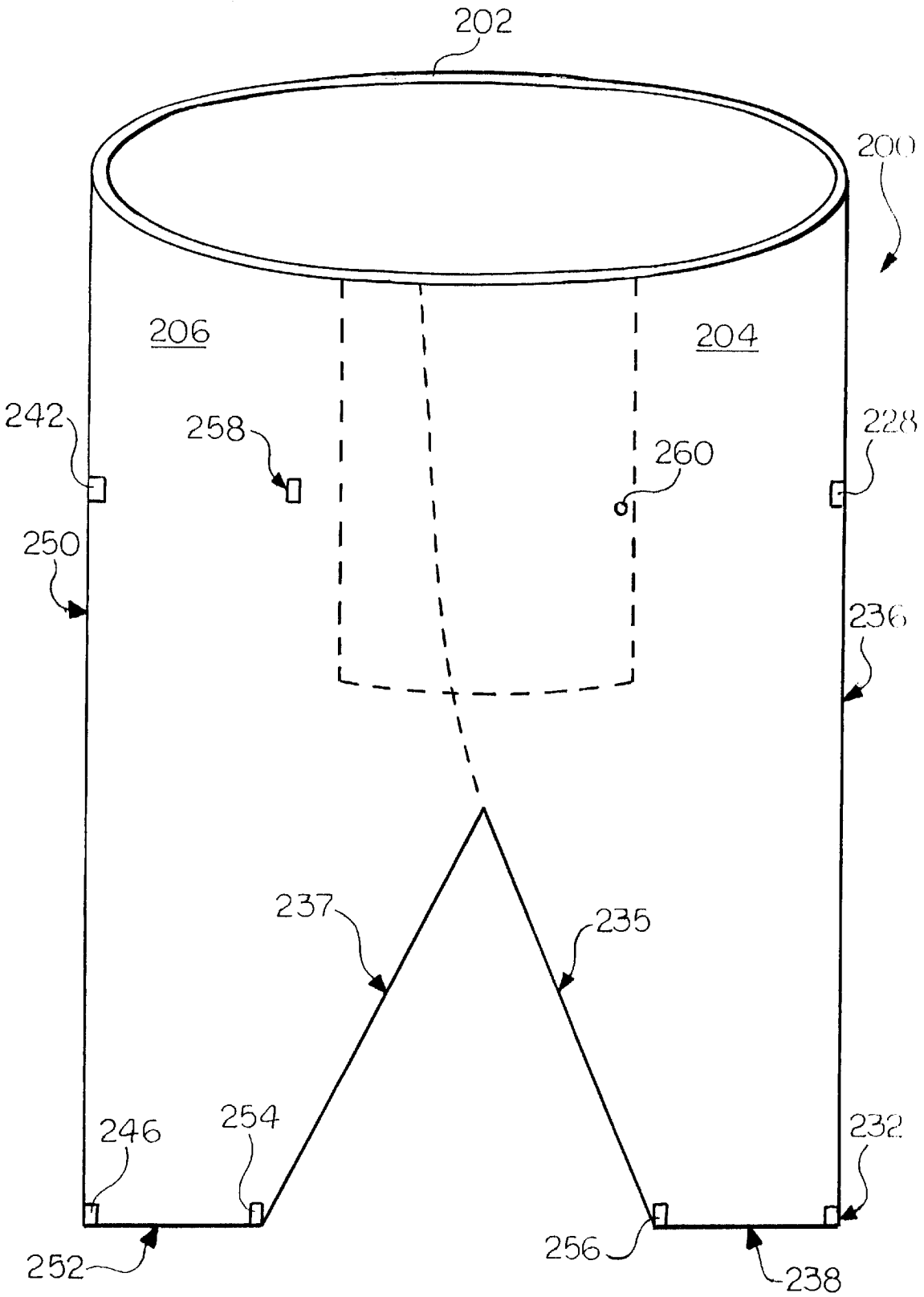
FIG. 10 is a front view of a second embodiment of a lower garment according to this invention wherein the front panels have been extended to form leggings.
Figure 11:
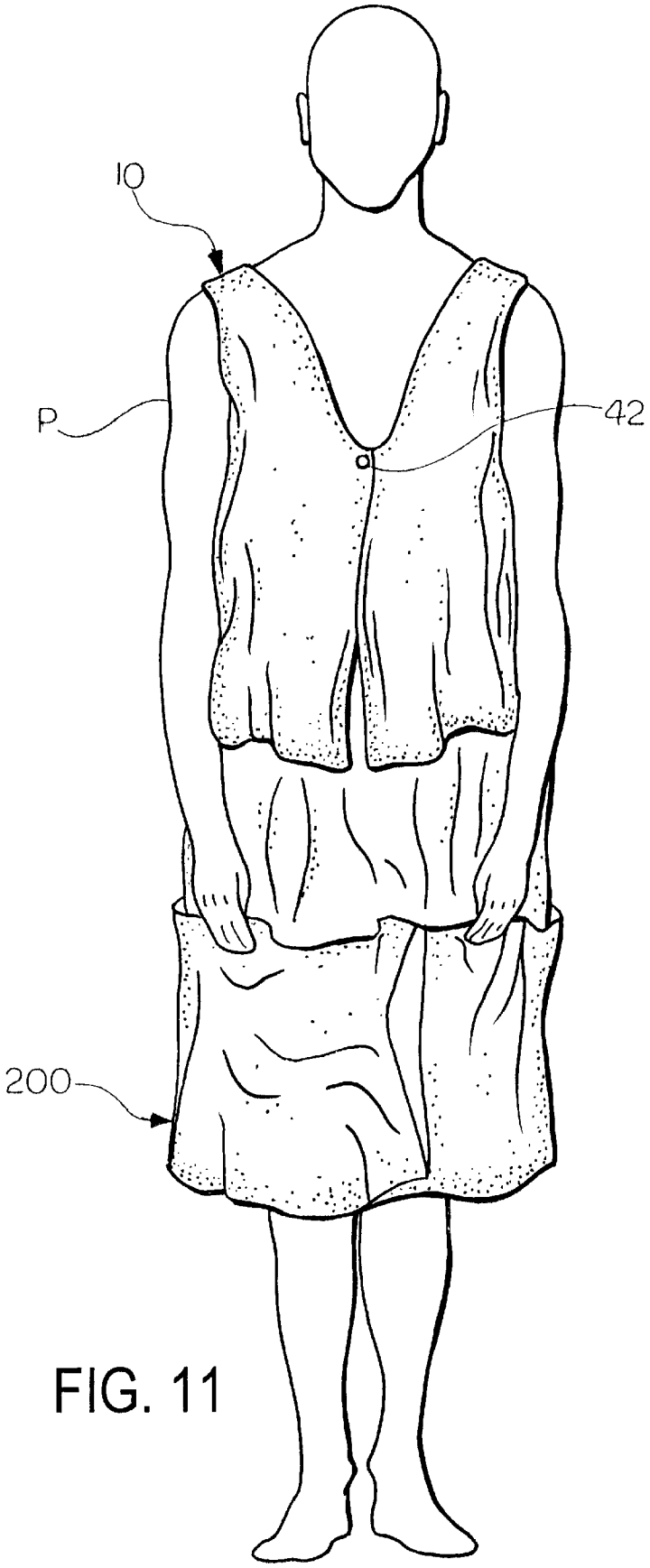
FIG. 11 is a front view of a patient wearing the upper garment of FIGS. 1–4 and the lower garment of FIG. 10.
Figure 12:
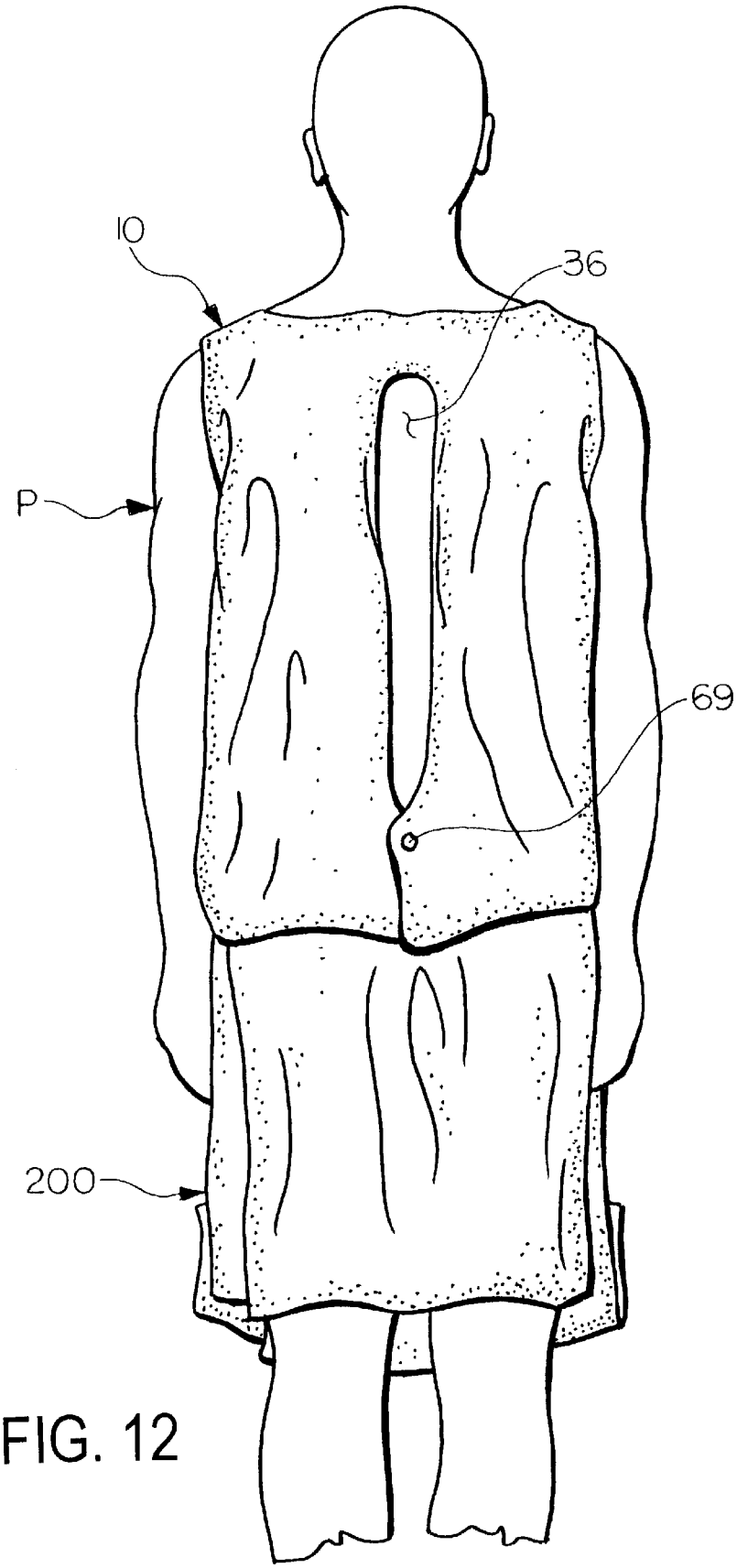
FIG. 12 is a rear view of the patient of FIG. 11 wearing the upper garment of FIGS. 1–4 and the lower garment of FIG. 10.

More, less, or the number of fasteners illustrated in FIGS. 5–9 can be provided on the lower garment 100. is A second embodiment of a lower garment for a patient is indicated generally at 200 in FIGS. 10 and 12. In a folded position, not shown, the lower garment 200 is fitted about the waist level of a patient and extends to approximately knee level, resembling a skirt. In the extended or unfolded position, as shown in FIG. 10, two anterior panels can be extended to the ankle area. The lower garment 200 is designed to permit a physician to conduct a clinical examination of a patient's abdomen, genitalia, anal and rectal areas, and lower extremities while provided a satisfying amount of patient coverage.

The lower garment 200 includes a waistband 202, preferably formed from an elastic material that supports the lower garment 200 at approximately waist level. A first front panel 204 and a second front panel 206 are attached to the waistband 202 and partially overlap one another. A central, inner front panel 208 is also attached to the waistband 202 and is overlapped by panels 204 and 206. The central panel 208 is sized to cover a patient's external genitalia. Each of panels 204 and 206 can be independently folded on the abdomen for an examination of one or both lower extremities without disturbing the central panel 208.

The panels 204 and 206 can be arranged in a stored or folded position so that coverage extends to approximately the level of the knees, similar to the arrangement in FIG. 5. In FIG. 10, panels 204 and 206 can be folded down as shown to provide leggings 212 and 216, respectively, similar to the arrangement in FIG. 6. Preferably, the leggings 212 and 216 (approximately the lower halves of panels 204 and 206) are narrowed from the approximately upper halves or portions of panels 204 and 206, respectively. For example, the width of the leggings 212 and 216 can be reduced to approximately twelve inches at the approximate ankle level, significantly less than the upper portions of the panels 204 and 206.

As illustrated in FIG. 10, fasteners 228, 232, 256 and 260 are provided on the first front panel 204. Fastener 228 is provided along an outer edge 236 at a central portion of its length. Fastener 232 is provided along the outer edge 236 at a bottom edge 238. Fastener 256 is provided along an inner edge 235 at the bottom edge 238. Fastener 260 is provided approximately midway the width of the upper portion of panel 204 and approximately aligned with fastener 228.

Fasteners 242, 246, 254, and 258 are provided on the second front panel 206. Fastener 242 is provided along an outer edge 250 at a central portion of its length. Fastener 246 is provided along the outer edge 250 at a bottom edge 252. Fastener 254 is provided along an inner edge 237 at the bottom edge 252. Fastener 258 is provided approximately midway the width of the upper portion of panel 206 and approximately aligned with fastener 242.

In the folded position (not shown), fastener 232 is mated with fastener 228, and fastener 256 is mated with fastener 260 to retain the legging 212. Fastener 246 is mated with fastener 242, and fastener 254 is mated with fastener 258 to retain the legging 216.

In the extended (unfolded) position (FIG. 10), fasteners 256 and 232 can be mated to wrap the legging 212 about a patient's leg. Fasteners 254 and 246 can be mated to wrap the legging 116 about a patient's leg.

The upper garment 10 and the lower garments 100, 200 can be formed from any desired materials, including a disposable material, a biodegradable material, or cloth. A patient can wear only one of the garments 10 or 100/200, or both, depending upon the extent of the examination. The locations and number of fasteners shown in the figures and described above are illustrative only and are not limiting.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A two piece examination garment to be worn by a patient during a physical examination, the examination garment comprising:

an upper garment piece adapted to be worn on an upper body portion of a patient, said upper garment piece including a first front panel, a second front panel, a rear panel having an opening, and a first plurality of fasteners removably joining said panels together whereby when said upper garment piece is worn on the upper body portion of the patient, said opening permits examination of the patient's spine; and a lower garment piece adapted to be worn on a lower body portion of the patient in cooperation with said upper garment piece including a waistband, a first front panel overlapping at least a portion of a second front panel, a front central panel overlapped by said first and second front panels, a rear outer panel, a rear in lower panel having an opening overlapped by the said rear outer panel, and a second plurality of fasteners removably joining said front and rear panels of said lower garment piece.

2. The examination garment according to claim 1 wherein said upper garment piece rear panel includes a slot that forms said opening for examination of the patient's spine.

3. The examination garment according to claim 1 wherein said upper garment piece rear panel includes first and second rear panels each having a cutout, said cutouts cooperating to form said opening.

4. The examination garment according to claim 3 including a slit extending from said opening to a lower edge of said upper garment piece rear panel and separating said upper gannent piece first and second rear panels, said slit permitting at least one of said upper garment piece first and second rear panels to be folded away from a back of the upper body portion of the patient to permit examination of the back side of the upper body portion of the patient.

5. The examination garment according to claim 1 including a slit formed between at least one of said upper garment piece first and second front panels and said upper garment piece rear panel to permit examination of a side of the upper body portion of the patient.

6. The examination garment according to claim 1 herein said lower garment piece front central panel is sized to cover external genitalia of the patient.

7. The examination garment according to claim 1 wherein said lower garment piece first and second front panels are sired so that when said lower garment portion is worn on the lower body portion of the patient with said waistband about a waist of the patient, in a folded position each of said lower garment piece first and second front panels extends to approximately a knee level of the patient and in an extended position extends to approximately an ankle level of the patient to form a legging.

8. The examination garment according to claim 1 including at least one fastener for removably connecting a lower portion of said lower garment piece first front panel with an upper portion of said lower garment piece first front panel.

9. The examination garment according to claim 1 including at least one fastener for removably connecting a lower portion of said lower garment piece second front panel with an upper portion of said lower garment piece second front panel.

10. A patient examination garment to be worn over an upper torso of a patient comprising:

a first front panel;

a second front panel;

a rear panel having an opening of a predetermined width in a predetermined position; and a plurality of fasteners removably joining said front and rear panels whereby when said garment is worn over an upper torso portion of a patient, said opening permits examination of the patient's spine without moving said panels.

11. The examination garment according to claim 10 wherein said rear panel includes a slot that forms said opening.

12. The exarnuntion garment according to claim 10 wherein said rear panel includes first and second rear panels each having a cutout, said cutouts cooperating to form said opening.

13. The examination garment according to claim 12 including a slit extending from said opening to a lower edge of said upper garment piece rear panel and separating said upper garment piece first and second rear panels, said slit permitting at least one of said upper garment piece first and second rear panels to be folded away from a back of the upper body portion of the patient to permit examination of the back side of the upper body portion of the patient.

14. The examination garment according to claim 10 including a slit formed between at least one of said first and second front panels and said rear panel to permit examination of a side of the upper torso portion of the patient.

15. A patient examination garment to be worn over a pelvic region of a patient comprising:

a waistband;

a pair of front outer panels attached to said waistband;

a front inner panel attached to said waistband and overlapped by said front outer panels;

a rear outer panel attached to said waistband;

a rear inner panel attached to said waistband and having an examination opening overlapped by said rear outer panel, and a plurality of fasteners removably joining said front and rear panels whereby when said garment is worn over a pelvic region of a patient with said waistband about a waist of the patient, said front and rear panels can be selectively moved for exposing portions of the pelvic region for examination and for exposing said examination opening.

16. The examination gannent according to claim 15 wherein said front inner panel is sized 1to cover external genitalia of a patient.

17. The examination garment according to claim 15 wherein said front outer panels are sized so that when the garment is worn over a pelvic region of a patient with said waistband about a waist of the patient, in a folded position each of said front panels extends to approximately a knee level of the patient and in an extended position extends to approximately an ankle level of the patient to form a legging.

18. The examination garment according to claim 15 including at least one fastener for removably connecting one of said front outer panels with said front inner panel.

19. The examination garment according to claim 18 including at least another fastener for removably connecting another of said front outer panels with said front inner panel.

20. The examination garment according to claim 15 wherein each of said front outer panels includes a reduced width portion that forms a legging.

* * * * *